US005298922A

United States Patent [19]

Merkle et al.

[11] Patent Number: 5,298,922

[45] Date of Patent: Mar. 29, 1994

[54] MULTILAYER DATA CARRIER AND METHODS FOR WRITING ON A MULTILAYER DATA CARRIER

[75] Inventors: Hansjurgen Merkle; Joseph Lass, both of Munich; Alexander Hierweger, Rottach-Egern; Wolfgang Killar; Erwin Lob, both of Munich, all of Fed. Rep. of Germany

[73] Assignee: GAO Gesellschaft f. Automation v. Organ. MBH, Fed. Rep. of Germany

[21] Appl. No.: 445,800

[22] Filed: Dec. 4, 1989

[30] Foreign Application Priority Data

Dec. 2, 1988 [DE] Fed. Rep. of Germany ..... 3840729

[51] Int. Cl.[5] ..... B41J 2/435

[52] U.S. Cl. ..... 346/1.1; 283/85; 346/76 L; 346/135.1; B41J/2/435

[58] Field of Search ..... 346/76 L, 135.1; 430/945; 369/277, 275.4; 283/94, 904, 91, 85

[56] References Cited

U.S. PATENT DOCUMENTS

| | | | |
|---|---|---|---|
| 3,560,994 | 2/1971 | Wolff | 346/76 L X |
| 4,069,487 | 1/1978 | Kasai | 346/76 L |
| 4,214,249 | 7/1980 | Kasai | 346/76 L |
| 4,230,939 | 10/1980 | de Bont | 346/76 L X |
| 4,310,916 | 1/1982 | Dil | 369/275.4 X |
| 4,345,261 | 8/1982 | Wilkinson | 346/76 L |
| 4,379,299 | 4/1983 | Fitzpatrick et al. | 346/1.1 |
| 4,506,916 | 3/1985 | Kuhl . | |
| 4,507,346 | 3/1985 | Maurer et al. . | |
| 4,523,777 | 6/1985 | Holbein | 346/135.1 X |
| 4,544,181 | 10/1985 | Maurer et al. . | |
| 4,564,409 | 1/1986 | Kuhl . | |
| 4,596,409 | 6/1986 | Holbein et al. . | |
| 4,597,593 | 7/1986 | Maurer | 283/91 |
| 4,732,410 | 3/1988 | Holbein et al. . | |
| 4,735,670 | 4/1988 | Maurer | 156/272.8 |
| 4,837,134 | 6/1989 | Bouldin et al. | 346/135.1 |

*Primary Examiner*—Joseph W. Hartary
*Attorney, Agent, or Firm*—Robert J. Koch

[57] ABSTRACT

A multilayer identity card exhibits an outer color layer of a first color and an inner color layer of a second color to allow for identity cards and the like to be written on in several colors. While the outer color layer absorbs virtually no laser beam light used for writing, the second, inner color layers absorbs the laser light. This causes the material of the second color layer to be thermally broken down during the writing operation, i.e. vaporized, sublimated, exposed to a chemical or physical reaction, so that the formation of pressure and resulting eruption blasts the first layer into particles. This makes the second color layer visible. Instead of the second color layer one can also provide a transparent layer of varnish having suitable properties in order to expose a multicolor security print, for example, below this transparent layer of varnish.

44 Claims, 3 Drawing Sheets

MULTILAYER DATA CARRIER AND METHODS FOR WRITING ON A MULTILAYER DATA CARRIER

BACKGROUND OF THE INVENTION

1. Field of the Invention

The present invention relates to a data carrier, in particular an identity card, and to methods for producing such a data carrier.

Specifically, the data carriers in question here are identity cards, e.g. check cards, credit cards, entitlement cards or calling cards and the like. Such identity cards have a standardized format and generally possess a multilayer structure. One side of the card shows general information applied e.g. by pressure or photographically, e.g. the name of a credit institution, an organization or the like, and possibly a security print (guilloche pattern) that is provided on the card surface or within the card. Furthermore, the user-related information, such as the name of the card owner, the customer number, the account number, the card number or the like, is provided.

2. Description of the Related Technology

In order to write on multilayer identity cards in color, German patent document no. 30 48 733 which corresponds to U.S. Pat. No. 4,523,777 the disclosure of which is expressly incorporated herein, proposes to provide different colored layer areas one on top of the other. The absorption behavior and vaporization points of the various color layers may be selected so that appropriate control of a laser beam intensity allows selective removal of color layers. The outermost color layer may be removed at lower laser beam intensities than the lower color layers.

The problem with these data carriers is that, due to tolerances of the layer thicknesses and small intervals between the vaporization or sublimation points, one often requires several radiation passes to obtain the complete removal of the various layers that is absolutely necessary for a high-contrast representation. With this writing method, several removal operations are thus necessary for each removed layer, which is an obstacle for large scale production of such data carriers. The color selection is also restricted by the fact that the color layers are coordinated with the laser beam intensity in terms of the absorption behavior of the particular color and the vaporization points of the various color layers.

SUMMARY OF THE INVENTION

An object of the invention is to provide a data carrier and particularly an identity card exhibiting overlapping contrasting color layers to show information which is at least partially warranty, readable though localized removal of individual layer by a laster to expose lower layers and colors. It is a further object to perform the removal of layers easily and quickly. The invention is also intended to provide a method for writing on a multilayer data carrier.

According to the invention a data carrier such as an identity card may show information in an at least partly humanly readable form through local removal of individual overlapping and contrasting color layer areas. Exposure of a deeper layer area of a different color may be effected incidence of a laser beam. The card includes a first color layer permeable to a laser beam and at least one second layer adapted to be thermally broken down at least partly under the effect of a laser beam located under the first layer. The conversion of the laser beam energy in the second layer and the resulting thermal breakdown of the material of the second layer locally removes the first color layer.

The thickness and breakdown behavior of the second thermal breakdown color layer may be coordinated to the laser beam intensity in such a way as to be removed only down to a certain depth.

The second color layer may be sensitized to the laser radiation by admixture of pigments that absorb laser light whose body color and/or concentration are adapted to the colorant in such a way that its color is barely influenced. The pigments may be soot particles or aluminum bronze particles. According to an advantageous features the second, thermal breakdown layer may be a transparent layer of varnish. The transparent layer of varnish may be sensitized with pigments which have a light body color and/or are present in such a low concentration that they barely affect the transparency of the layer of varnish.

The data carrier color layers may be layers of ink preferably applied by screen printing. Alternatively, the color layers may be dyed plastic films. According to an advantageous embodiment, the first color layer may be a halftone print. Furthermore, the color layer may be a black halftone print that changes its intensity from place to place and is applied to a different colored second layer. A multicolor printed pattern may be located under the second color layer or under the transparent varnish layer. The printed pattern may be a security pattern, preferably a guilloche pattern. Alternatively, the printed pattern may be a relief print, e.g. a steel intaglio print, and the relief may be continuous across the layers thereabove.

The data carrier may exhibit a first color layer and a second breakdown layer have a relief structure, preferably in the form of semicylindrical elements, hemispherical elements, corrugated structures or the like. The information may be recorded by a laser at an acute angle to the plane of the data carrier and the slopes of the relief structure facing the recording direction are affected differently than the slopes facing away therefrom. The information thus recorded appears in different forms depending on the particular viewing angle.

According to a further feature, a data carrier and in particular an identity card may have an outer opaque layer or writing which changes its color or contrast to the surroundings visibly under the effect of a laser beam. At least the opaque surface may have a relief structure, preferably in the form of semicylindrical elements, hemispherical elements. corrugated structures and the like. Information is recorded by a laser beam at an acute angle to the plane of the data carrier in the area of this relief structure. The slopes of the relief structure facing the recording direction are written on or affected differently than the slopes facing away therefrom, so that the information thus recorded appears differently depending on the particular viewing angle.

Further, features of the invention include a method for writing on a data carrier and in particular an identity card, having overlapping layers in color contrast showing information in an at least partly humanly readable form through local removal of individual layer areas and exposure of deeper layer areas of different color by a laser beam. A second layer may be adapted to be thermally broken down and is located below a first color layer permeable to a laser beam. The second layer may be broken down at least partially in some pieces by the effect of a laser beam, and the areas of the first layer located above these places are thereby torn off.

According to the invention, a method of writing on a multilayer data carrier and in particular an identity card, having overlapping layers in color contrast showing information in an at least partly humanly readable form through local removal of individual layer areas and exposure of deeper layer areas of different colors by means of a laser beam may be affected. An embossed structure, e.g. in the form of semicylindrical or hemospherical elements or corrugated structures may be formed at least in part of the surface of these color layers, and during the information recording the laser beam is directed across this embossed structure at a certain acute angle. The data carrier may then be rotated on its plane relative to the direction of laser radiation, and the laser beam again directed across the embossed structure at a certain acute angle. This will result in multiple different images being visible at different viewing angles.

While the upper first layer, in the prior art, reacts to the incident laser beam and is removed, thereby exposing the second layer therebelow and making its color visible, the first layer of the inventive data carrier is penetrated by the laser beam without showing any essential effect. Only the material of the second layer therebelow is thermally broken down by the penetrating laser beam. The term "thermal breakdown" signifies in the present context vaporization, i.e. a transition from the solid to the liquid phase and then to the gaseous phase, sublimation, i.e. a transition from the solid to the gaseous phase, chemical decomposition with gas formation, or a chemical reaction such as occurs e.g. with thermite particles are ignited.

The thermal breakdown of the material of the second layer at the place hit by the laser beam causes an abrupt increase in the inside pressure of the card material at this place, so that the relatively thin layer area thereabove cannot withstand the high pressure and is blasted off, so to speak. During a writing operation, in the course of which a laser beam is directed across the card surface in accordance with the information to be recorded, small areas of the second layer are thermally broken down continuously or pixel by pixel, and small areas of the outer first color layer is then freed from the color layer thereabove, so that the information thus recorded is visible in color contrast to these two color layers.

In a normal writing operation laser energy passes through the first layer and is absorbed by the second layer. A thermal breakdown of part of the material in the second layer causes a pressure build up and eruption through the first layer. The eruption causes localized removal or flaking of the first layer thereby exposing the layers below. The second layer is visible if not entirely removed. Further, exposure to the laser energy may cause complete breakdown of the second layer and expose the base layer.

The second color layer contrasting with the outer color layer must be coordinated in its thickness and breakdown behavior with the intensity of the laser beam in such a way as to be removed only partially. After the writing operation the second color layer is thus exposed in the areas hit by the laser beam, and its color is clearly recognizable.

In particular for the second color layer, which is to be thermally broken down, a relatively large assortment of colors is visible which can be given the desired properties by admixture of pigments. Such pigments sensitize the second color layer. They may be soot particles or aluminum bronze particles, for example, depending on whether a dark or a light color is involved. The pigments are selected in terms of their body color and/or concentration in such a way as to leave the inherent color of the color layer virtually unaffected, i.e. the pigments intended for sensitizing should have no influence of their own on the coloration of this layer. Thus, almost any type of color (acrylic paint, PVC paint, etc.) in any desired shade can be modified and used in the modified form for the inventive writing.

The pigments in the color layer act as absorption centers which absorb the incident laser light, thereby releasing thermal energy which vaporizes color, for example, so that this vapor pressure blasts off the material of the first layer at the place hit by the laser beam.

In an alternative embodiment that is advantageous for many applications, the second layer, i.e. the thermal breakdown layer may be a transparent layer of varnish which is embedded between two contrasting color layers. This varnish layer is also sensitized, like the aforesaid color layer, by admixture of pigments that absorb the laser light. Suitable pigments for this purpose are those having a light body color (e.g. aluminum bronze particles) or those showing a sufficient effect under the action of a laser beam even in small concentrations (e.g. in the per mill range) but not essentially affecting the transparency of the varnish layer. When the data carrier then bears writing, one can see through the at least partly removed transparent varnish layer to the color layer below. The color layer below may be designed e.g. as a multicolor print or as a monochrome layer.

The color layers ar preferably ink layers applied by the screen printing technique, or suitably dyed thin overlapping plastic films.

The effect of the writing is particularly interesting in the inventive data carriers when the first, i.e. the outer, color layer is a halftone print (or a first color layer provided with a halftone print), in particular a black gradual matrix changing its intensity from place to place, i.e., having a nonuniform intensity place and applied to a different colored second layer. Due to the thermal breakdown second layer the halftone print is locally removed, so that the written characters differ from the background e.g. only in their shade of color. Such gradual matrices are known as such. They appear in an identity card e.g. as a shadow that becomes darker from the lower edge of the card to the upper edge.

In particular when a transparent varnish layer is used as the thermal breakdown layer there is a possibility of providing a multicolor print below the varnish layer since the latter leaves the print in the lower layer fully intact. One can thereby achieve particularly effective patterns which also constitute effective protection from forgery, in particular when the multicolor print is a guilloche pattern.

Interesting optical effects can be achieved if the print results in a relief structure e.g. by steel intaglio printing, or a relief structure is embossed on which continues over the layers thereabove. These relief surfaces can be written on by the inventive method in the same way a smooth surfaces. The protection from forgery offered by laser engraving (or writing) is particularly effective here, since such structures cannot be written on in this simple way by the mechanical engraving method known as such involving chisels.

If the laser beam is directed to this relief surface at an acute angle, the recorded information changes its appearance in accordance with the viewing angle and, in the extreme case, is visible only from the side on which recording is performed.

A guilloche print which is applied to the carrier material and extends so far into the second, thermal breakdown layer that it is exposed after laser radiation also increases the protection from falsification of forgery. After the first color layer is removed, the guilloche print located in the second color layer and contrasting with this color layer becomes clearly visible. This, too, impedes forgery or falsification by means of a chisel and makes the special security of laser engraving clear.

It is particularly effective to write on a data carrier using a laser beam at an acute angle to the data carrier when the data carrier is provided with an embossed structure in the form of e.g. corrugation, semicylinders, hemispheres, lenticular elements or the like. One can first direct the laser beam across the embossed structure in a certain direction at a certain angle to the plane of the data carrier. Only the "slopes" of this embossed structure facing the laser beam are thereby written on. If the data carrier is then rotated on its plane and the laser beam directed at the same or a different acute angle across the embossed structure, the slopes of the embossed structure are written on by the laser beam on one side and then on the other side. In accordance with the writing direction, a different image results when viewed from the corresponding direction if the various sides of the embossed structure are designed accordingly. It is therefore possible to produce different pictures for different viewing angles on opaque surfaces, whereby these pictures can also be viewed separately in accordance with the viewing angle or can combine to one picture when viewed perpendicularly.

Exemplary embodiments of its invention are explained below in more detail with reference to the drawings.

DETAILED DESCRIPTION OF THE PREFERRED EMBODIMENT

Figure 1:
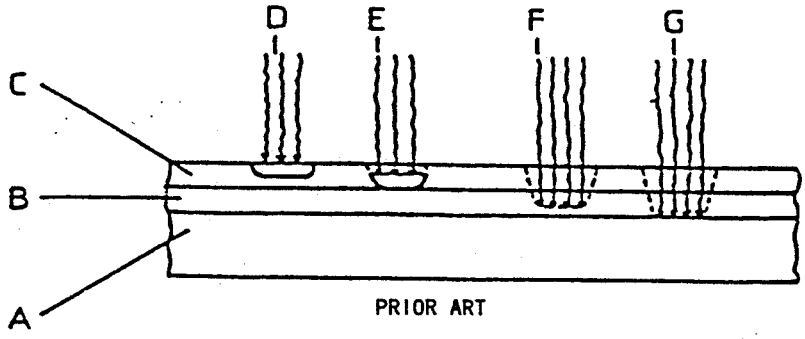
FIG. 1 shows a sketch illustrating the prior art.

FIG. 1 shows a cross section of part of a known identity and such as is shown in German laid open document no. 30 48 733 corresponding to U.S. Pat. No. 4,523,777 which may be a check card, for example. On a base layer a there are two color layers B and C. For the sake of clarity, the card layers in this and the following figures are not shown true to scale. These two color layers differ in their color and in their absorption properties and vaporization points. Since the layer thicknesses are not always exactly uniform at different places but fluctuate within certain limits, and the vaporization points are generally relatively close together, it is difficult to dose the laser beam intensity to expose the particular desired color layer. The layers are therefore preferably removed step by step in several radiation operations at accordingly low intensity, to expose a layer selectively and not accidentally cause incomplete or complete removal together with other layers. For example, to expose the color layer B one performs several, e.g. two, writing steps (D,E) to remove an area in layer C. One might then perform further writing steps (F,G) to remove a place in layer B. In this way one produces multicolor representations in several procedural steps.

Figure 2:
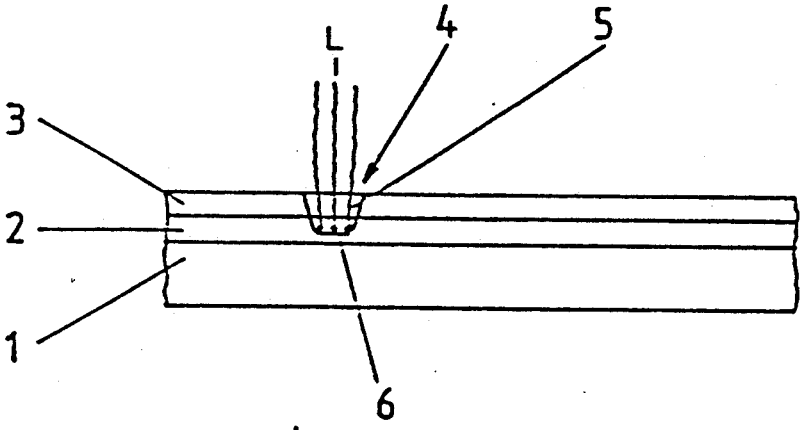
FIG. 2 is a partially cross sectional view of a data carrier in which writing is provided by means of a laser beam.

FIG. 2 shows an identity card according to the present invention. A base layer 1 bears on the outside a first color layer 3 substantially permeable to laser light, and a second color layer 2 that absorbs laser light and is provided with pigments. The colors of layers 2 and 3 are different.

Color layers which absorb no, or almost no, laser light are known. Colorants which absorb laser light in the stated way are obtained according to the invention by adding pigments to almost any colorant which has a dark or light body color depending on the lightness of the colorant. In the case of dark colors one uses soot particles; for light colors aluminum bronze particles, for example. This makes it possible for the color to retain its shade regardless of the pigments added.

In FIG. 2 a laser beam recording is performed at a place 4 at a right angle to the plane of the identity card. Laser beam L penetrates first color layer 3 in an area 5. In this area 5 the energy of the laser beam is virtually not absorbed by the material of first color layer 3.

In second color layer 2, however, part of the laser beam energy is absorbed by the pigments contained in this color layer 2. This leads to a breakdown (vaporization, sublimation, ect.) of the material of second color layer 2 in area 6. The pressure resulting from this breakdown blasts off first color layer 3 thereabove, whereby this blast is limited relatively narrowly to place 4 which is hit by laser beam L. Color layer 2, in particular its thickness, breakdown properties, etc., are coordinated with each other in such a way that the second color layer is removed only partially and thus becomes visible in contrast with the first color layer.

Figure 3:
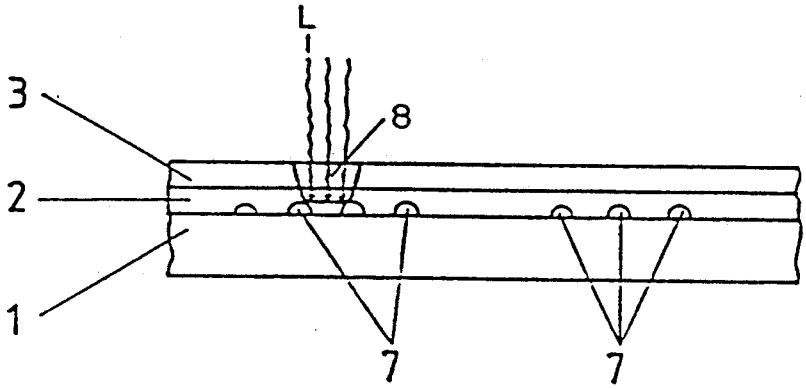
FIGS. 3 to 6 show further embodiments of a data carrier incross section.

As shown in FIG. 3, this second color layer 2 can also be applied to a guilloche print 7, for example. The guilloche lines are then exposed, and thus visible, to a greater or lesser degree depending on how marked the craters 8 produced by the laser beam are.

Figure 4:
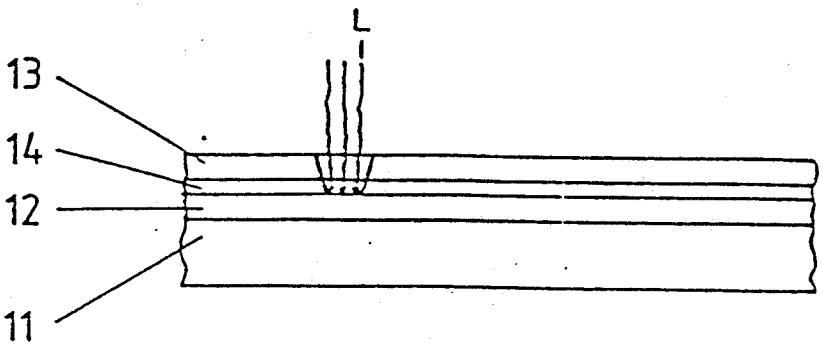

FIG. 4 shows a further embodiment of an identity card in a cross-sectional view. A base layer 11 bears on the outside a first color layer 13 with a transparent varnish layer 14 and a further color layer 12 therebelow. Color layers 13 and 12 have different colors. The transparent varnish layer, which may be a transparent synthetic resin which contains pigments in low concentration which absorb the, laser light. As shown in FIG. 3, a laser beam penetrates upper color layer 13 and breaks down the affected area in transparent varnish layer 14, thereby blasting off upper color layer 13 in this area, so that color layer 12 below is visible through the resulting hole and through exposed transparent varnish layer 14. In addition to this base layer 11, the identity card may also have other layers which are of no interest here, e.g. a layer on the back of the card. The same applies to the card shown in FIG. 2.

Figure 5:
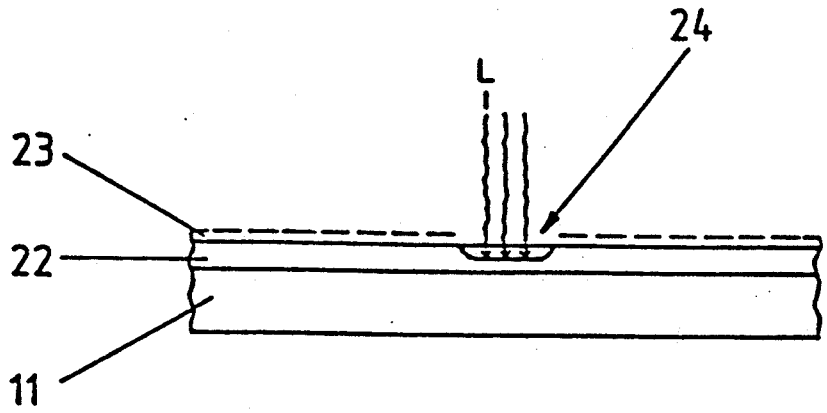

FIG. 5 shows an embodiment similar to that in FIG. 2, the difference being that first color layer 23 is formed here by a so called "halftone print" which gives the second color layer 22 only a preferably continuously changing shading. Halftone print 23 may be a fine black print which puts a kind of shadow on color layer 22 that e.g. becomes continuously darker from the lower edge of the identity card to the upper edge. The removal of individual areas 24 of halftone print 23 and parts of color layer 22, which was sensitized for the laser beam writing by admixture of pigments, completely exposes the latter. The written areas differ here from the unwritten areas only by the different shade of color.

Figure 6:
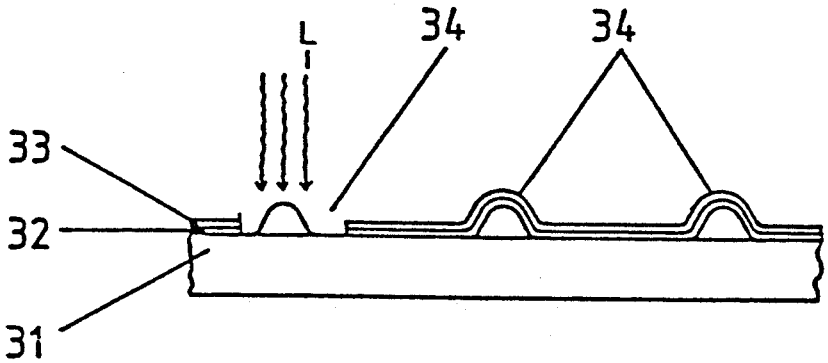

In the embodiment of FIG. 6, there are embossed areas 34 extending into the plane of projection on a base layer 31, while on the outside there is a continuous first color layer 33 which hardly absorbs laser light, and below first color layer 33 there is a second color layer 32 (which may also be transparent) that absorbs the laser light. Scanning with a laser beam removes individual areas of color layers 32 and 33. One can also remove second color layer 32 only down to a certain depth so that its color is visible, or replace it by a transparent varnish layer sensitized in the above described way by admixture of pigments. In the latter case, the top of base layer 31 or embossed areas 34 is then visible in the written areas.

Figure 7:
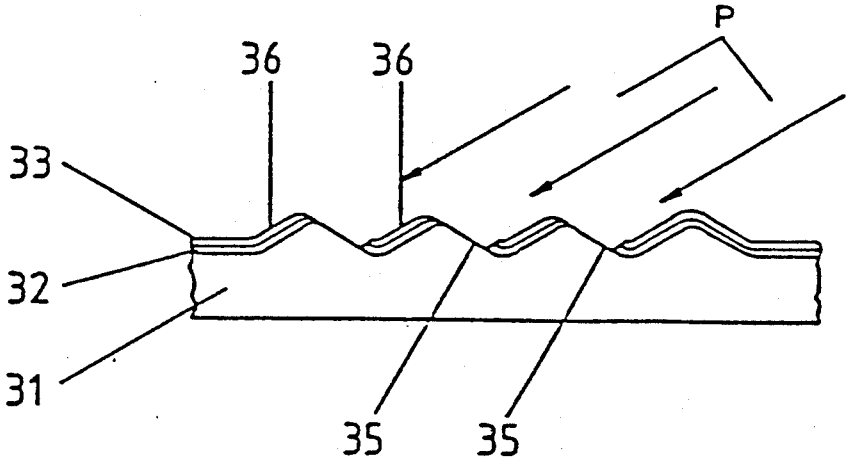
FIG. 7 shows a data carrier written on at an acute angle.

In FIG. 6 the laser beam hits the plane of the identity card more or less perpendicularly. However, one can also direct the laser beam to the identity card at an acute angle, as shown in FIG. 7 by arrows P. The structure of the card of FIG. 7 is basically similar to that in FIG. 6. However, the oblique radiation of laser light produces "writing" only on slopes 35 of embossed areas 34 facing the light source, while slopes 36 facing away from the light source are hardly or not at all affected by the laser light.

Due to the acute angle between the incident laser beam and the plane of the identity card, it is possible to make outer color layer 33 continuously visible from one side (from the left in FIG. 7), while mainly the areas exposed by the laser light writing are visible from the other side (the right in FIG. 7).

Figure 8:
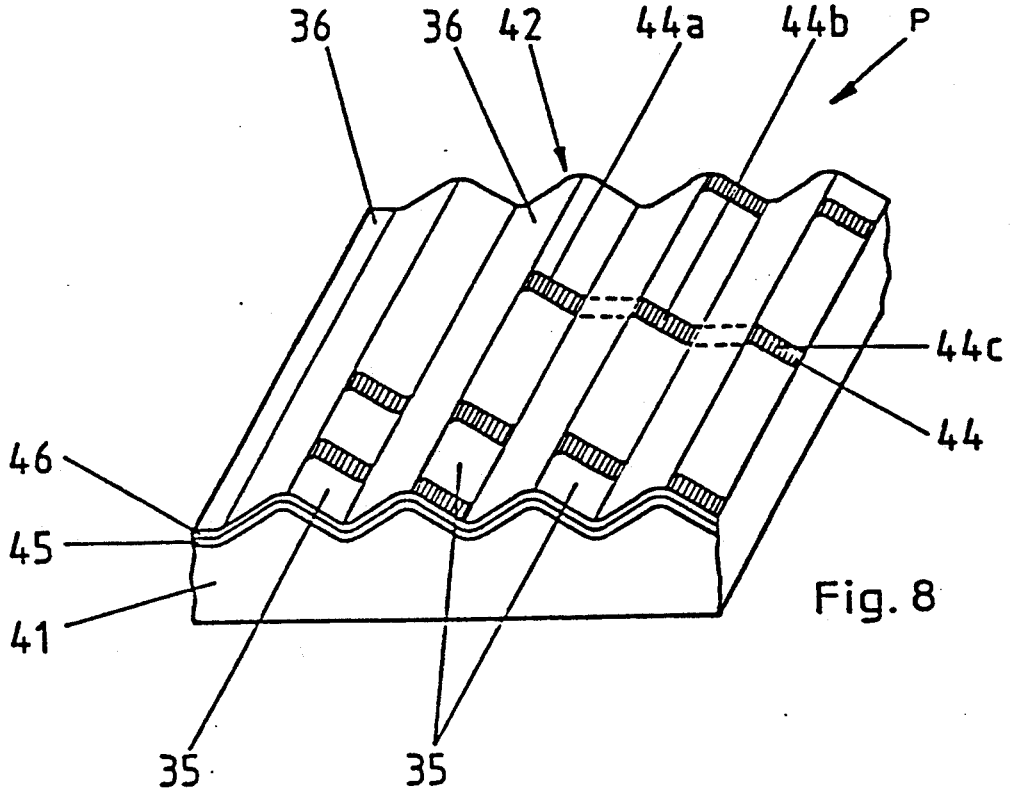
FIG. 8 shows a sketch illustrating the scanning of a data carrier provided with an embossed structure with a laser beam at an acute angle.

FIG. 8 shows a different view of a layer 41 provided with an embossed structure 42 (in a corrugated form). Above this base layer 41 there is, according to the aforesaid inventive structure, e.g. a transparent thermal breakdown varnish layer 45 and thereabove an outer color layer 46. The data carrier may be scanned by a laser beam at an acute angle following the direction of the arrow, so that base 41 is exposed e.g. in a linear shape on slopes 35 of embossed structure 42 facing the laser and shown in FIG. 7. In the case of a linear recording operation, for example, only sections 44*a, b, c* are exposed on a scanning line 44 due to the shadow caused by the embossed structures. One thus obtains a direction dependent picture that cannot be reproduced in this form by copying or photographic techniques.

If the data carrier is then rotated by 180° or the laser beam deflected accordingly, one can perform a further writing operation in the course of which a different picture is provided, possibly in a different color, on opposite slopes 36 of the embossed structure by exposing deeper layers.

Figure 9:
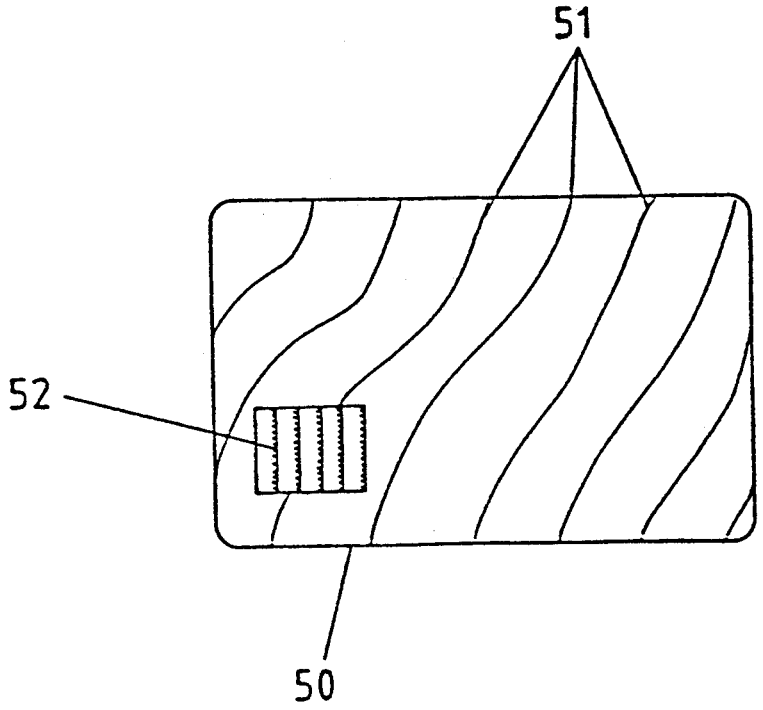
FIG. 9 shows a top view of an identity card with different relief structures.

As shown in FIG. 9, one can apply such optically varying pictures to an identity card 50 over large surfaces by providing the entire card with individual embossed lines 51, for example, that pass through the card and follow substantially a predetermined direction. However, one can also provide only part of the card with an embossed structure 52, whereby the embossed structures, as shown in FIG. 8, are present directly adjacent each other in a continuous form. This area may be written on e.g. from different directions with different picture motifs, which may in turn be seen only separately from the particular recording direction, and combine to form one picture when viewed perpendicularly.

The last described embodiments considerably increase the protection of the identity card from forgery. Such engravings, which appear as extremely sharp edged written areas on an uneven surface due to the inventive measure of removing areas of an upper color layer, cannot be obtained by simple mechanical engraving means.

The production of such "pictures having a directional effect" by writing on relief structures at an acute radiation angle is basically also possible with convential card structures as shown e.g. in FIG. 1. But the cards may also have only a simple opaque structured surface or surface writing which changes color under the effect of a laser beam. The information is not produced by removing layers and exposing deeper layers in color contrast, but by a direct color change in an outer plastic or color layer.

We claim:

1. A data carrier comprising:

overlapping layers of different contrasting colors showing information in humanly identifiable form through local removal of areas of an individual layer and exposure of areas of a deeper layer of a different color by a laser beam, said overlapping layers including at least one thermal breakdown second layer located under a first colored non-metallic layer configured to be permeable by a laser beam, whereby said at least one thermal breakdown second layer is configured to be broken down at least partly under the effect of a laser beam, and wherein said data carrier is configured so that conversion of energy supplied by the laser beam in said at least one second layer and resulting thermal breakdown of said at least one second layer locally remove said first colored non-metallic layer.

2. The data carrier is colored layer and exhibits a thickness and breakdown behavior coordinated to laser beam intensity in such a way as to be removed only down to a certain depth.

3. The data carrier of claim 1, wherein said at least one second layer is sensitized by admixture of laser light absorbing pigments exhibiting a body color adapted to layer colorants in such a way that layer color is barely influenced.

4. The data carrier of claim 3, wherein said pigments are soot particles.

5. The data carrier of claim 1, wherein said at least one thermal breakdown second, layer is a transparent layer of varnish.

6. The data carrier of claim 5, wherein said transparent layer of varnish is sensitized with pigments exhibiting a light body color and adapted to barely affect the transparency of the layer of varnish.

7. The data carrier of claim 1, wherein said layers are layers of ink.

8. The data carrier of claim 1, wherein said layers are dyed plastic films.

9. The data carrier of claim 1, wherein said first colored non-metallic layer is a halftone print.

10. The data carrier of claim 9, wherein said first colored non-metallic layer is a black halftone print exhibiting a nonuniform intensity and contacting a different colored second layer.

11. The data carrier of claim 1, further comprising a multicolor printed pattern under the at least one thermal breakdown second thermal breakdown layer.

12. The data carrier of claim 11, wherein said printed pattern is a security pattern.

13. The data carrier of claim 11, wherein said printed pattern is a relief print.

14. The data carrier of claim 13, wherein said relief print is continuous across the layers thereabove.

15. The data carrier of claim 1, wherein at least said first colored non-metallic layer and said at least one thermal breakdown second layer have a relief structure, wherein the structure of recorded information is such that information is recorded at an acute angle to a plane of said data carrier and slopes of said relief structure facing a recording direction are written on differently than slopes facing away therefrom, so that the information thus recorded appears in different forms depending on the particular viewing angle.

16. A data carrier comprising:

an outer opaque layer configured to show an at least in a part visible change in color or contrast under the effect of a laser beam;

a relief structure, comprising semicylindrical elements, hemispherical elements or corrugated structures, formed in at least said part of said opaque layer; said relief structure having first sloped surfaces facing toward a recording direction and second sloped surfaces facing away from the recording direction;

a direction dependent picture recorded in said first sloped surfaces by a laser beam at an acute angle to the plane of said data carrier so that said picture thus recorded appears in different form depending on the particular viewing angle.

17. A method for writing on a data carrier having overlapping layers of different contrasting colors showing information in human identifiable form through local removal of areas of an individual layer and exposure of areas of a deeper layer of a different color by a laser beam, comprising the steps of:

directing the laser beam into a second layer adapted to be thermally broken down;

breaking down the second layer at least partially in some places by the effect of the laser beam; and removing areas of a first outer layer located above the broken down areas of the second layer.

18. A method for writing on a multilayer data carrier having overlapping layers of different contrasting colors showing human identifiable form through local removal of areas of an individual layer and exposure of areas of a deeper layer of a different color by a laser beam, comprising the steps of:

forming an embossed structure at least in a part of a surface of the overlapping layers; and directing the laser beam across the embossed structure at a certain acute angle during the information recording.

19. The method of claim 17, wherein the data carrier is thereafter rotated on a plane of the data carrier relative to the direction of laser radiation, and the laser beam is then directed across the embossed structure at a certain angle.

20. The data carrier of claim 6, wherein said layers of different contrasting colors are layers of ink.

21. The data carrier of claim 6, wherein said layers of different contrasting colors are dyed plastic films.

22. The data carrier of claim 6, wherein said first colored non-metallic layer is a halftone print.

23. The data carrier of claim 6, further comprising a multicolor printed pattern under the at least one thermal breakdown second layer.

24. The data carrier of claim 2, wherein said second layer is sensitized by admixture of laser light absorbing pigments exhibiting a body color adapted to layer colorants in such a way that layer color is barely influenced.

25. The data carrier of claim 5, wherein said first colored non-metallic layer is a black halftone print exhibiting a nonuniform intensity and located on said at least one second layer which is of a different contrasting color.

26. The data carrier of claim 1, wherein said at least one second layer is sensitized by admixture of laser light absorbing pigments at a concentration adapted to layer colorants in such a way that layer color is barely influenced.

27. The data carrier of claim 3, wherein said pigments include aluminum bronze particles.

28. The data carrier of claim 26, wherein said pigments include soot particles.

29. The data carrier of claim 26, wherein said pigments include aluminum bronze particles.

30. The data carrier of claim 5, wherein said transparent layer of varnish is sensitized with a low concentration of pigments adapted to barely affect transparency of the layer of varnish.

31. The data carrier of claim 7, wherein said layers of ink include screen printed layers of ink.

32. The data carrier of claim 12, wherein said security pattern includes a guilloche pattern.

33. The data carrier of claim 13, wherein said relief print includes a steel intaglio print.

34. The data carrier of claim 15, wherein said relief structure includes semicylindrical elements.

35. The data carrier of claim 15, wherein said relief structure includes hemispherical elements.

36. The data carrier of claim 15, wherein said relief structure includes corrugated structures.

37. The data carrier of claim 16, wherein said relief structure includes semicylindrical elements.

38. The data carrier of claim 16, wherein said relief structure includes hemispherical elements.

39. The data carrier of claim 16, wherein said relief structure includes corrugated structures.

40. The data carrier of claim 20, wherein said layers of ink include screen printed layers of ink.

41. The data carrier of claim 2, wherein said at least one second layer is sensitized by admixture of laser light absorbing pigments at a concentration adapted to layer colorants in such a way that layer color is barely influenced.

42. The method of claim 18, wherein the step of forming an embossed structure includes forming semicylindrical elements.

43. The method of claim 18, wherein the step of forming an embossed structure includes forming hemispherical elements.

44. The method of claim 18, wherein the step of forming an embossed structure includes forming corrugated structures.

* * * * *